United States Patent [19]

Speil et al.

[11] Patent Number: 4,747,376

[45] Date of Patent: May 31, 1988

[54] HYDRAULIC VALVE CLEARANCE COMPENSATION ELEMENT

[75] Inventors: Walter Speil, Ingolstadt; Dieter Schmidt, Nuremberg, both of Fed. Rep. of Germany

[73] Assignee: INA Walzlager Schaeffler KG, Fed. Rep. of Germany

[21] Appl. No.: 70,895

[22] Filed: Jul. 8, 1987

[30] Foreign Application Priority Data

Nov. 8, 1986 [DE] Fed. Rep. of Germany ..... 3638202

[51] Int. Cl.[4] ..... F01L 1/24

[52] U.S. Cl. ..... 123/90.55; 123/90.5; 123/90.46

[58] Field of Search ..... 123/90.55, 90.46, 90.5

[56] References Cited

U.S. PATENT DOCUMENTS

| | | | |
|---|---|---|---|
| 4,361,120 | 11/1982 | Kueny | 123/90.55 |
| 4,541,373 | 9/1985 | Ishida | 123/90.55 |
| 4,607,599 | 8/1986 | Buente et al. | 123/90.55 |
| 4,633,827 | 1/1987 | Buente | 123/90.55 |

FOREIGN PATENT DOCUMENTS

| | | | |
|---|---|---|---|
| 2758957 | 7/1979 | Fed. Rep. of Germany | 123/90.55 |
| 3541198 | 5/1987 | Fed. Rep. of Germany | 123/90.46 |
| 210206 | 9/1986 | Japan | 123/90.55 |
| 210204 | 9/1986 | Japan | 123/90.55 |

*Primary Examiner*—E. Rollins Cross

*Attorney, Agent, or Firm*—Bierman & Muserlian

[57] ABSTRACT

An hydraulic valve clearance compensation element comprising a housing in which a pressure piston is guided and a pressure space is disposed behind the pressure piston, an oil inlet chamber with an oil inlet opening to supply oil to the pressure space, characterized in that the pressure space (13) and guide means (5) for the pressure piston (6,7) is formed by the base (1), the oil inlet chamber (23) is provided between the base (1) and a housing sleeve (18) which is arranged concentrically at the piston side of the base (1) and the oil inlet opening (26) is provided on the housing sleeve (18).

11 Claims, 3 Drawing Sheets

HYDRAULIC VALVE CLEARANCE COMPENSATION ELEMENT

STATE OF THE ART

Hydraulic valve clearance compensation elements comprising a housing in which a pressure piston is guided and a pressure space is disposed behind the pressure piston and an oil inlet chamber with an oil inlet opening to supply oil to the pressure space are known from EP No. 0,180,872 and EP No. 0,190,418 wherein the housings are massively formed. The oil inlet chambers are comparatively small and the oil inlet openings are slantingly drilled thus complicating the oil supply. To prevent a twisting of the element in a bore of a motor block, EP No. 0,180,872 proposes to provide flattenings at the housing which flattenings are feasible when massively constructing the housing, but they complicate a lightweight construction.

OBJECTS OF THE INVENTION

It is an object of the invention to provide an hydraulic valve clearance compensation element of the abovementioned type of lightweight construction with an improved oil supply.

This and other objects and advantages of the invention will become obvious from the following detailed description.

THE INVENTION

The hydraulic valve clearance compensation element of the invention comprising a housing in which a pressure piston is guided and a pressure space disposed behind the pressure piston, an oil inlet chamber with an oil inlet opening to supply oil to the pressure space, is characterized in that the pressure space (13) and guide means (5) for the pressure piston (6,7) is formed by the base (1), the oil inlet chamber (23) is provided between the base (1) and a housing sleeve (18) which is arranged concentrically at the piston side of the base (1) and the oil inlet opening (26) is provided on the housing sleeve (18).

The overall housing is not massive but consists of a massive base frame and the comparatively light housing sleeve so that a reduction of the moved masses is achieved. The capacity of the oil inlet chamber is comparatively large as the oil inlet opening is directly provided at the housing sleeve and does not have to be slantingly drilled. Thus, the oil supply of the pressure space is obtained practically without any loss.

Advantageously, the oil supply channel provided in the motor block and feeding the oil inlet chamber via the oil inlet opening does not have to extend tangentially to the guide bore arranged in the motor and provided for the valve engine but may radially extend perpendicular to the axis of the valve clearance compensation element. The oil supply to the oil inlet chamber is guaranteed over the entire stroke of the compensation element.

In a preferred embodiment of the invention, an oil outlet opening is arranged at the circumference of the housing sleeve and is spaced from the oil inlet opening, preferably by 180°. The oil outlet opening communicates with an oil channel which is provided in the motor block and leads to the adjacent compensation element. The oil inlet chamber of one compensation element receives oil from the one side and feeds it at the other side to the adjacent compensation element.

To prevent a twisting of the element in the guide bore of the motor block, in accordance with a further development of the invention, the housing sleeve includes an opening in which a guide element is inserted which projects into the oil inlet chamber and extends beyond the outer periphery of the housing sleeve. The guide bore of the motor block is provided with a respective guide slot for the guide element.

According to another feature of the invention, the outer surface of the housing sleeve defines the guide surface of the valve tappet in the guide bore of the motor block. Thence, the base frame of the housing does not have to contribute to the guidance of the compensation element. Further advantageous embodiments of the invention are disclose in the following description of an exemplified embodiment illustrated in the drawing.

REFERRING NOW TO THE DRAWINGS

Figure 1:
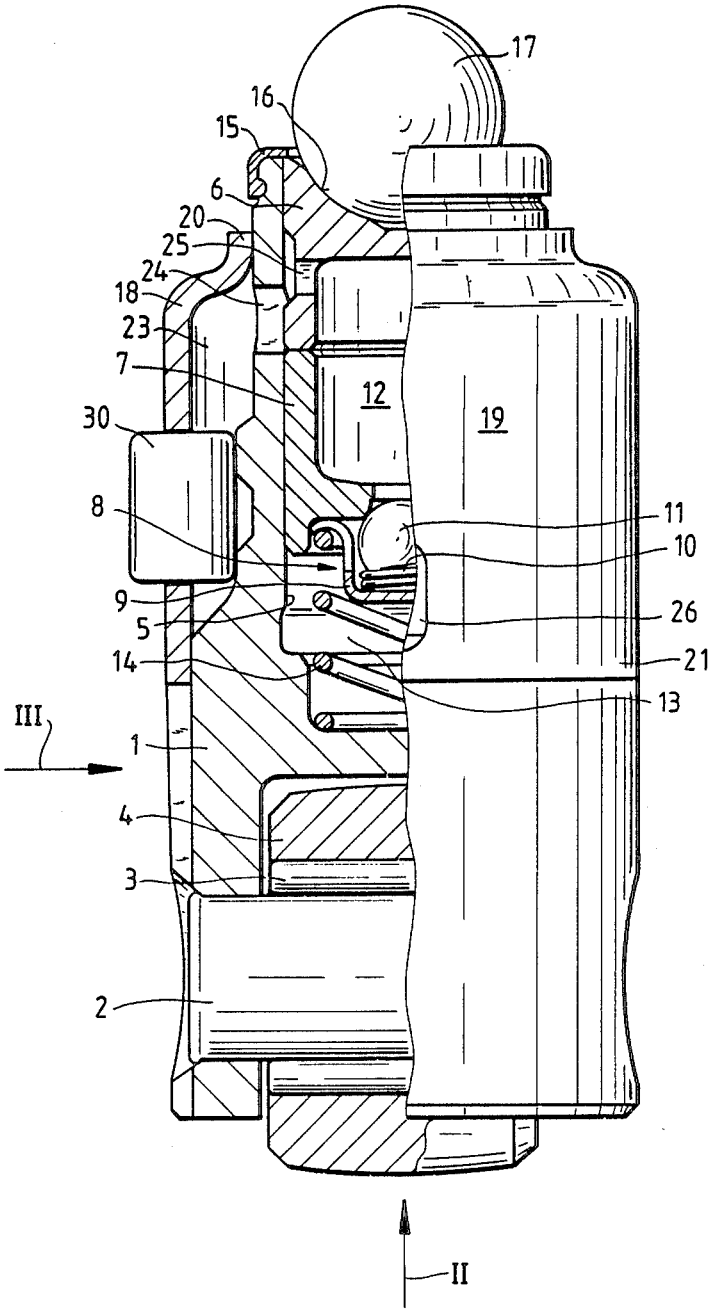
FIG. 1 is a half view of a hydraulic valve clearance compensation element of the invention.

The compensation element comprises a base frame 1 and a bolt 2 is attached thereto which supports a roller 4 via needle rollers 3. Inserted into a recess 5 of the base frame 1 is a two piece hollow piston 6,7 at whose bottom portion 7 a check valve 8 comprising a valve cap 9, a compression spring 10 and a valve ball 11 is arranged. The check valve 8 connects the inner space 12 of the hollow piston 6,7 with a pressure space 13 within the base frame 1 behind the piston 6,7.

Arranged within the pressure space 13 is a pressure spring 14 which acts on the piston bottom element 7 and biases the piston top element 6 against a restraining cap 15 secured to the base frame 1. The top element 6 is provided with a spherical socket 16 for receiving a pressure ball 17 which extends beyond the restraining cap 15.

The base frame 1 is tapered in the area of the piston 6,7 and in this area, a housing sleeve 18 is placed on the base frame 1. The housing sleeve 18 includes a hardened annular element formed in non-cutting manner and ground at its outside surface 19. At its one end, the housing sleeve 18 is provided with a neck 20 which is welded to the base frame 1. At its other end 21, the housing sleeve 18 sits on a shoulder 22 of the base frame 1 and may also be welded at this area to the base frame 1.

Accommodated between the housing sleeve 18 and the base frame 1 is a circulating oil inlet chamber 23 of considerable capacity in comparison to the capacity of the pressure space 13. In the area of the oil inlet chamber 23, the base frame 1 is provided with an opening 24 and associated therewith is an opening 25 of the top element 6. The openings 24, 25 are designed so that a communication between the oil inlet chamber 23 and the inner space 12 and thus the pressure space 13 is provided at each stroke position of the piston 6,7.

Figure 2:
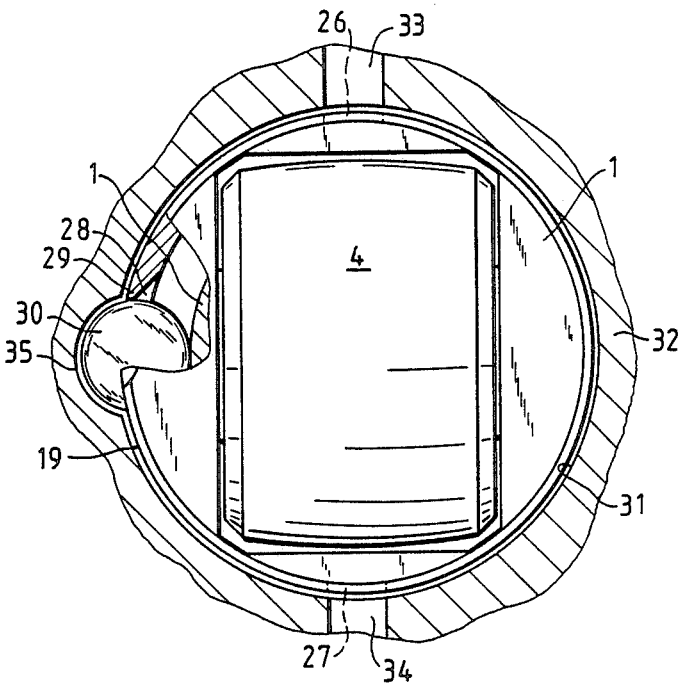
FIG. 2 is a partial sectional view of the embodiment of FIG. 1 in direction of arrow II of FIG. 1.
Figure 3:
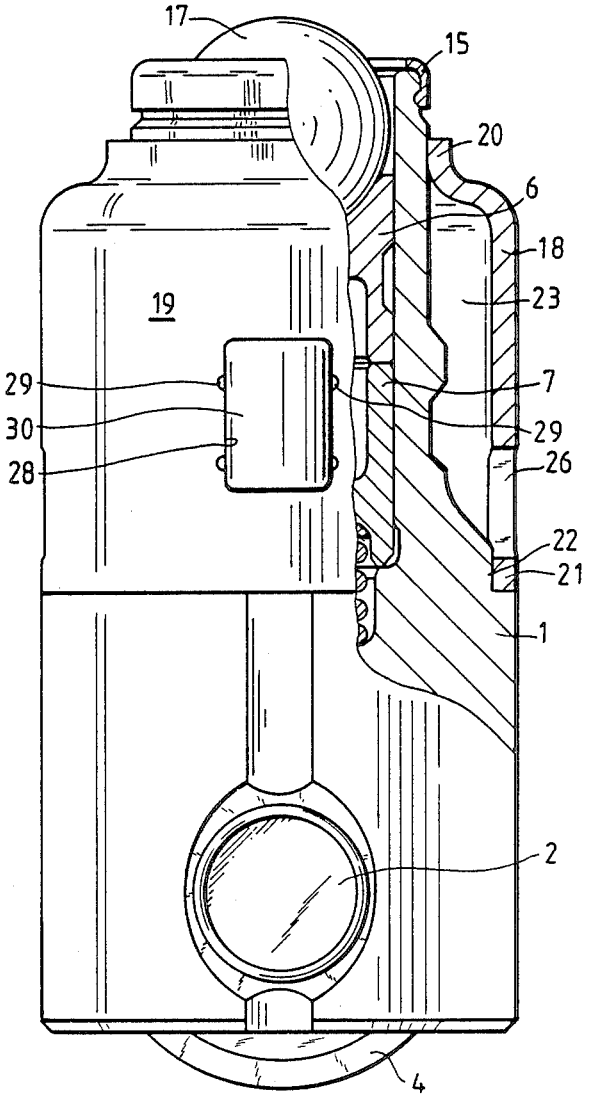
FIG. 3 is a partial sectional half view of the embodiment of FIG. 1 taken along arrow III.

The housing sleeve 18 includes an oil inlet opening which is designed as an oblong hole 26 and located near the shoulder 22. An oil outlet opening 27 is arranged at the outer periphery of the housing sleeve 18 and is spaced from the oil inlet opening 26 by 180° (See FIG. 2). The oil inlet opening 27 is also designed as an oblong hole.

The housing sleeve 18 is provided with an opening 28 defining an edge to which restraining noses 29 are embossed. The restraining 29 radially retain a needle roller 30 which is provided as a guide element without rolling function during axial displacement of the compensation element. The restraining noses 29 may, however, be arranged so that they axially retain the needle roller.

The needle roller 30 protrudes into the oil inlet chamber 23 and may abut against the base froma 1. With a portion of its outer periphery, the roller needle 30 exceeds the outer surface 19 of the housing sleeve 18 and is disposed in an almost oiltight manner in the opening 28. The use of a roller needle as guide element is advantageous since such needle rollers can be produced in quantitites and their fixation is simple. The needle roller 30 is arranged at the circumference of the housing sleeve 18 and is spaced 90° from the oil inlet opening 26 and the oil outlet opening 27.

The described compensation element is inserted in a guide bore 31 of a motor block 32 and acting on the roller 4 is a not shown camshaft of the internal combustion engine. The pressure ball 17 lies against a not shown valve drive and an oil supply channel 33 is provided in the motor block 32 and radially extends perpendicular to the oblong hole 26. Likewise, the motor block 32 is provided with an oil discharge channel 34 which radially extends perpendicular to the oil outlet opening 27 and is in alignment with the latter. The oil discharge channel 34 leads to an oil inlet opening which is part of a not shown adjoining and similar compensation element. The oblong holes 26, 27 are designed so that a communication thereof with the channels 33,34 is provided at each stroke position of the compensation element.

The housing sleeve 18 guided in the guide bore 31 thus defines a comparatively large oil inlet chamber 23, on the one hand, while the oil inlet chamber 23 defines a permeable connection to the oil inlet chamber of the adjoining compensation element via the oil discharge channel 34, on the other hand.

The housing sleeve 18 constitutes a secure axial guidance of the compensation element in the guide bore 31 and prevents a twisting of the compensation element in the guide bore 31 by providing a groove 35 in correspondence to the needle roller 30. By providing the base frame 1 with a tapered diameter in the area of the piston 6,7, not only is a voluminous oil inlet chamber 23 obtained but also a reduction of moved masses of the compensation element is achieved.

Figure 4:
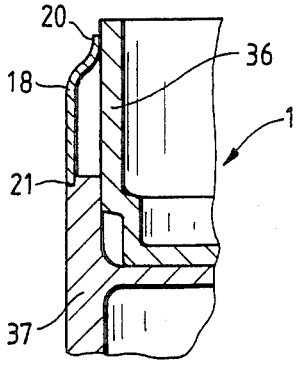
FIG. 4 is a partial sectional view of another embodiment of the invention.

In the embodiment of FIG. 4, the base frame 1 comprises a piston guide element 36 and a base element 37. The piston guide element may be a comparatively thin-walled series element and is inserted in the base element 37. The housing sleeve 18 is securely connected with its one end 21 to the base element 37 and at the neck 20, the piston guide element 36 may be securely connected to the housing sleeve 18. It may, however, also be guided loosely within the housing sleeve 18 and within the base element 37. By other embodiments, it is also possible to securely connect the guide element 30 with the base frame to prevent a loss thereof.

Various modifications of the compensation element of the invention may be made without departing from the spirit or scope thereof and it is to be understood that the invention is to be limited only as defined in the appended claims.

What we claim is:

1. An hydraulic valve clearance compensation element comprising a housing in which a pressure piston is guided and a pressure space disposed behind the pressure piston, an oil inlet chamber with an oil inlet opening to supply oil to the pressure space, characterized in that the pressure space (13) and guide means (5) for the pressure piston (6,7) is formed by the base (1), the oil inlet chamber (23) is provided between the base (1) and a housing sleeve (18) which is arranged concentrically at the piston side of the base (1) and the oil inlet opening (26) is provided on the housing sleeve (18).

2. A clearance compensation element of claim 1 wherein an oil outlet opening (27) is arranged at the circumference of the housing sleeve (18) and is offset with respect to the oil inlet opening (26).

3. A clearance compensation element of claim 2 wherein the oil outlet opening (27) is arranged at the housing sleeve (18) and is offset by 180° with respect to the oil inlet opening (26).

4. A clearance compensation element of claim 2 wherein at least one of the oil inlet opening (26) and oil outlet opening (27) is defined as an oblong hole to provide an open connection to the oil inlet chamber (23) at each stroke position of the compensation element.

5. A clearance compensation element of claim 1 wherein the housing sleeve (18) is provided with an opening (28) into which a guide means (30) is inserted and which projects into the oil inlet chamber (23) and exceeds the outer periphery (19) of the housing sleeve (18).

6. A clearance compensation element of claim 5 wherein the guide element (30) is arranged at housing sleeve (18) circumference and is spaced from the oil inlet opening (26) and the oil outlet opening (27).

7. A clearance compensation element of claim 1 wherein the outer surface (19) of the housing sleeve (18) defines the guide surface for the valve tappet in a guide bore (31).

8. A clearance compensation element of claim 1 wherein the base (1) has an opening (24) in the area of the oil inlet chamber (23) and the piston (6,7) is provided with an opening (25) communicating at each stroke position of the piston (6,7) with the opening (24) of the base (1).

9. A clearance compensation element of claim 1 wherein the housing sleeve (18) has a neck (20) connected to an area of base (1) of reduced diameter.

10. A clearance compensation element of claim 1 wherein the housing sleeve (18) has one end (21) resting on a shoulder (22) of base (1).

11. A clearance compensation element of claim 1 wherein the base (1) comprises a piston guide element (36) and a base element (37).

* * * * *